US010035167B2

(12) United States Patent
Walter et al.

(10) Patent No.: US 10,035,167 B2
(45) Date of Patent: Jul. 31, 2018

(54) VALVE ARRANGEMENT FOR APPLYING FLUID MEDIA TO SURFACES

(71) Applicant: Focke & Co. (GmbH & Co. KG), Verden (DE)

(72) Inventors: Jan-Christian Walter, Hamburg (DE); Marc-Daniel Stegen, Hamburg (DE); Nils Neuhaus, Buxtehude (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 15/112,440

(22) PCT Filed: Jan. 22, 2015

(86) PCT No.: PCT/EP2015/000111
§ 371 (c)(1),
(2) Date: Jul. 19, 2016

(87) PCT Pub. No.: WO2015/120956
PCT Pub. Date: Aug. 20, 2015

(65) Prior Publication Data

US 2016/0332185 A1 Nov. 17, 2016

(30) Foreign Application Priority Data

Feb. 14, 2014 (DE) ..... 10 2014 001 897

(51) Int. Cl.
*B05C 5/02* (2006.01)
*B05C 3/00* (2006.01)
(Continued)

(52) U.S. Cl.
CPC ..... *B05C 5/0225* (2013.01); *B05C 3/005* (2013.01); *B05C 5/001* (2013.01); *B05C 5/0279* (2013.01); *B05C 11/1042* (2013.01)

(58) Field of Classification Search
CPC ..... B05C 5/0225; B05C 5/001; B05C 3/005; B05C 5/0279; B05C 11/1042;
(Continued)

(56) References Cited

U.S. PATENT DOCUMENTS 3,690,518 A 9/1972 Baker
4,487,596 A 12/1984 Livens
(Continued)

FOREIGN PATENT DOCUMENTS

CN 1292733 A 4/2001
CN 1660507 A 8/2005
(Continued)

OTHER PUBLICATIONS

Deutsches Patent—Und Markenamt (German Patent and Trademark Office), Recherchenbericht in (Search connection with a related application), dated Mar. 19, 2014.
(Continued)

*Primary Examiner* — Patrick M Buechner
*Assistant Examiner* — Robert Nichols, II
(74) *Attorney, Agent, or Firm* — Laurence P. Colton; Smith Tempel Blaha LLC

(57) ABSTRACT

A valve arrangement for applying fluid media, in particular glue, to surfaces, comprising a plurality of individual modules detachably connected to form a row, wherein in the row and between the adjacent individual modules is respectively formed a dividing plane, in which the respectively adjacent individual modules bear one against another, and at least one dividing plane is assigned a heating member for warming the valve arrangement, preferably a plurality of or all dividing planes are respectively assigned a heating member, which is seated in appropriate, mutually opposing receptacles, arranged to both sides of the dividing plane, of the two adjacent individual modules, and cooperates in such a
(Continued)

way with those walls of the individual modules which delimit the receptacles that relative movements of the two individual modules in at least one spatial direction are limited or prevented.

14 Claims, 6 Drawing Sheets

(51) Int. Cl.
*B05C 5/00* (2006.01)
*B05C 11/10* (2006.01)

(58) Field of Classification Search
CPC ..... B05C 17/00523; B05C 17/00546; B67D 7/80; B67D 7/82
USPC ..... 222/146.2
See application file for complete search history.

(56) References Cited

U.S. PATENT DOCUMENTS 5,237,794 A 8/1993 Ballestrazzi
6,220,843 B1 * 4/2001 Allen ..... B05B 7/0861 425/192 S
6,422,428 B1 * 7/2002 Allen ..... B05B 7/0807 222/255
2005/0230423 A1 10/2005 Riney
2009/0065611 A1 * 3/2009 Harris ..... B05C 5/0279 239/390

FOREIGN PATENT DOCUMENTS

| | | | |
|---|---|---|---|
| CN | 1689709 | A | 11/2005 |
| CN | 101356014 | A | 1/2009 |
| DE | 2157710 | C2 | 7/1983 |
| DE | 2349268 | C2 | 5/1984 |
| DE | 4013322 | A1 | 10/1991 |
| DE | 202005016120 | U1 | 4/2006 |
| DE | 102007048046 | A1 | 4/2009 |
| EP | 1588771 | A2 | 10/2005 |
| GB | 2297956 | A | 8/1996 |

OTHER PUBLICATIONS

WIPO, International Search Report (on parent application), dated Jul. 8, 2015.
Studio Torta, Remarks concerning the patentability of European patent application 15709410.3 according to Art. 115 EPC (related application), dated Mar. 24, 2017.
State Intellectual Property Office of the Peoples Republic of China, Notification of the First Office Action (in a related application), Apr. 16, 2018.

* cited by examiner

VALVE ARRANGEMENT FOR APPLYING FLUID MEDIA TO SURFACES

STATEMENT OF RELATED APPLICATIONS

The application is the US National Phase of International Application No. PCT/EP2015/000111 having an International Filing Date of 22 Jan. 2015, which claims priority on German Patent Application No. 10 2014 001 897.0 having a filing date of 14 Feb. 2014.

BACKGROUND OF THE INVENTION

Technical Field

The present invention relates to a valve arrangement for applying fluid media, in particular glue, to surfaces, comprising a plurality of individual modules detachably connected to form a row, wherein between the (in the row) adjacent individual modules is respectively formed a dividing plane, in which the adjacent individual modules bear one against another.

Prior Art

Valve arrangements or applicators consisting of a plurality of individual modules connected to form a row are known. In DE 40 13 322 A1 is shown, for example, a multiple applicator head, in which a plurality of individual valve modules are disposed in a frame-like applicator head. The multiple applicator head is not however suitable for the use of hot-setting glue, since the hot-setting glue would cool down on its way to the individual valve modules for lack of heating members. A further drawback is that the glue line spacings of the valves arranged in a row are limited by the width of the individual valve modules. In order to obtain still smaller glue line spacings, it is necessary—as is already proposed by DE 40 13 322 A1—to provide a second, parallel row of individual valve modules, the individual valve modules of which are arranged offset, in terms of their gaps, relative to the individual valves of the first row. Producing with just one row of individual valve modules a glue line spacing which is smaller than the valve width is not possible, however, within the scope of the teaching of DE 40 13 322 A1.

BRIEF SUMMARY OF THE INVENTION

The object of the present invention is to refine a valve arrangement of the type stated in the introduction.

This object is achieved by a valve arrangement for applying fluid media, in particular glue, to surfaces, comprising a plurality of individual modules detachably connected to form a row, wherein between the (in the row) adjacent individual modules is respectively formed a dividing plane, in which the respectively adjacent individual modules bear one against another, characterized in that at least one dividing plane is assigned a heating member for warming the valve arrangement, preferredly a plurality of or all dividing planes are respectively assigned a heating member, which is seated in appropriate, mutually opposing receptacles, arranged to both sides of the dividing plane, of the two adjacent individual modules, and cooperates in such a way with those walls of the individual modules which delimit the receptacles that relative movements of the two individual modules in at least one spatial direction are limited or prevented and by a valve arrangement characterized in that the individual modules respectively possess a cable duct, extending in the longitudinal direction of the valve arrangement, for power cables and, where appropriate, for control cables, which cable duct connects to a corresponding cable duct of the main body of an adjoining individual module.

According to the invention, it is provided that at least one of the dividing planes which are respectively formed between the adjacent individual modules is assigned a heating member for warming the valve arrangement, which heating member is seated in appropriate, mutually opposing receptacles, arranged to both sides of the dividing plane, of the two adjacent individual modules. Those walls of the individual modules which delimit the receptacles here cooperate with the heating member such that the heating member limits or prevents relative movements of the two individual modules in at least one spatial direction. Preferredly, such a heating member is in this way respectively assigned to a plurality of, particularly preferredly to each of the aforesaid dividing planes of the valve arrangement.

Preferably, the walls which delimit the receptacles are constituted by in particular upright walls, which extend transversely or perpendicularly to the longitudinal extent or longitudinal direction of the valve arrangement. Advantageously, at least one relative movement, running in particular transversely or perpendicularly to the longitudinal extent of the valve arrangement in the dividing plane, is here limited or prevented, in particular a relative movement which at the same time is made transversely to the longitudinal extent of the heating member.

The invention is based, on the one hand, on the finding that such an arrangement of the heating members leads to a particularly good heat distribution within the whole of the valve arrangement. If, as the fluid medium, hot-setting glue, for example, is fed to the valve arrangement, this hot-setting glue can hereby be kept very precisely, in all regions of the valve arrangement, at the desired temperature or, where appropriate, warmed to this temperature. At the same time, the particular arrangement of the heating members helps to ensure that the adjacent individual modules, in the at least one spatial direction, cannot or can only limitedly move relative to one another. In particular when the single individual modules are connected as part of the assembly of the valve arrangement, a position fixing which particularly facilitates this assembly is achieved.

In a further embodiment of the invention, it is provided that the heating member has a preferredly cylindrical peripheral surface, which lies opposite appropriate, in particular (part-)cylindrical inner surfaces of the mutually opposing receptacles of the adjacent individual modules, in particular bears against these inner surfaces. The inner surfaces are ultimately part of the walls delimiting the receptacles.

The heating member can extend perpendicularly to the longitudinal extent of the valve arrangement, in particular vertically, i.e. from top to bottom. The heating member is preferredly constituted by an elongate heating cartridge. Preferredly, the peripheral surface of the heating member touches the walls of the receptacles in which this is seated, or the inner surfaces; this in particular full-facedly, in order to enable a particularly good heat transfer between heating member and the adjacent walls or the inner surfaces of the individual modules.

Preferredly, the individual modules respectively possess a main body having a main medium duct, which latter extends in the longitudinal direction of the valve arrangement and connects to a corresponding main medium duct of the main body of an (in the row) adjacent individual module. Preferably, the corresponding main medium ducts of the adjacent individual modules are in this case mutually aligned.

In a further embodiment of the invention, a plurality of individual modules of the valve arrangement respectively possess a valve unit, detachably fastened (for example via screw joints) to a mounting surface of the respective main body, with metering opening for the discharge of the medium, in particular a solenoid valve unit. Moreover, each main body of each individual module having such a valve unit expediently possesses a branch medium duct leading to the valve unit. This can here run at an angle, in particular perpendicularly, to the main medium duct and connect thereto.

According to the independent concept according to the invention, it is provided that a plurality of the individual modules, which in the longitudinal direction or longitudinal extent of the valve arrangement are detachably connected to form a row, respectively possess a metering opening, disposed on the same side of the valve arrangement, for the discharge of the medium, in particular the glue. The metering openings of at least two of the individual modules arranged in this row are here disposed on an imaginary common, straight line running in particular parallel to the longitudinal direction of the valve arrangement. The metering opening at least of one other individual module of the individual modules arranged in this same, i.e. in the same row, is arranged at a distance to the aforesaid line, in particular at a distance in relation to the direction perpendicular to the longitudinal extent of the valve arrangement.

The distanced metering opening can ultimately, on the one hand, be positioned so far "in front of" the other metering openings disposed on the common line that the metering opening of the adjacent individual module does not collide with the aforesaid metering opening when this is positioned laterally recessed in the direction of the metering opening of the adjacent individual module. The metering opening of this individual module can therefore be placed, in relation to the longitudinal direction of the valve arrangement, at a distance to the adjacent individual module, which distance is smaller than the width of the individual modules. Correspondingly, depending on the positioning of the metering opening disposed at a distance to the aforesaid line, an almost optionally small medium line spacing can be realized; this without—as in the prior art—a second row of individual modules being necessary.

In a further embodiment of this concept, the individual modules with metering opening can respectively have an, in particular, detachably fastened valve unit with housing, in which valve unit the respective metering opening is integrated. Furthermore, the individual modules then in turn have a corresponding main body having, in each case, a mounting surface to which the respective housing of the valve unit is fastened. The mounting surface of the main body of that individual module whose metering opening is not disposed on the imaginary common line is then arranged at an angle, in particular a right angle, and at a distance to the mounting surfaces of the main bodies of the other individual modules whose metering openings are positioned on the imaginary common line. The distance is here preferably greater than the width of the housing of the respective valve unit.

Preferably, all the mounting surfaces of the main bodies of the individual modules whose metering openings are disposed on the imaginary common line lie in a common plane or are mutually aligned. The mounting surface of the main body of that individual module, however, whose metering opening is arranged at a distance to the line runs at an angle, in particular perpendicularly, and at a distance to this plane, or is correspondingly arranged.

In a further embodiment of this concept, the housing of the valve unit of that individual module whose metering opening is not disposed on the imaginary common line is positioned laterally offset in relation to the direction perpendicular to the longitudinal extent of the valve arrangement, behind the housing of the valve unit of an (in the row) adjacent individual module with metering opening lying on the imaginary common line, such that the two housings of the two individual modules overlap in the direction of the longitudinal extent of the valve arrangement.

According to a further preferred embodiment of the invention, the ratio of the width of the respective main body of the respective individual module with valve unit to the width of the valve unit disposed on the respective individual module, in particular to the width of the housing of the valve unit, amounts to no more than the value 2, particularly preferredly no more than the value 1.6. It has been shown that, at the aforesaid maximum width ratio, a good heat transfer is still ensured by the heating members disposed in the dividing planes between the modules and by the valve units. The width of the main body or the width of the valve unit or of the housing here naturally relate to the external dimensions in the longitudinal direction of the valve arrangement.

BRIEF DESCRIPTION OF THE DRAWINGS

Further features of the present invention emerge from the appended patent claims, the following description of a preferred illustrative embodiment and from the appended drawings, wherein:

DETAILED DESCRIPTION OF PREFERRED EMBODIMENTS

A valve arrangement or device according to the invention for applying fluid media to surfaces is made up of a plurality of individual modules 11.1-11.4 and 11.6-11.11. Within the scope of the Application, these individual modules are denoted in their entirety by 11.1-11.11 for simplification purposes.

In the shown illustrative embodiment, the valve arrangement 10 serves to apply glue, in particular hot-setting glue, to surfaces of blanks 12, made of paper, foil or the like, used in the manufacture of cigarette packs. However, it lies of course within the scope of the invention to apply with the valve arrangement 10 other fluid media, such as, for instance, paints, lacquers or the like, to surfaces of blanks or objects of different type.

Figure 1:
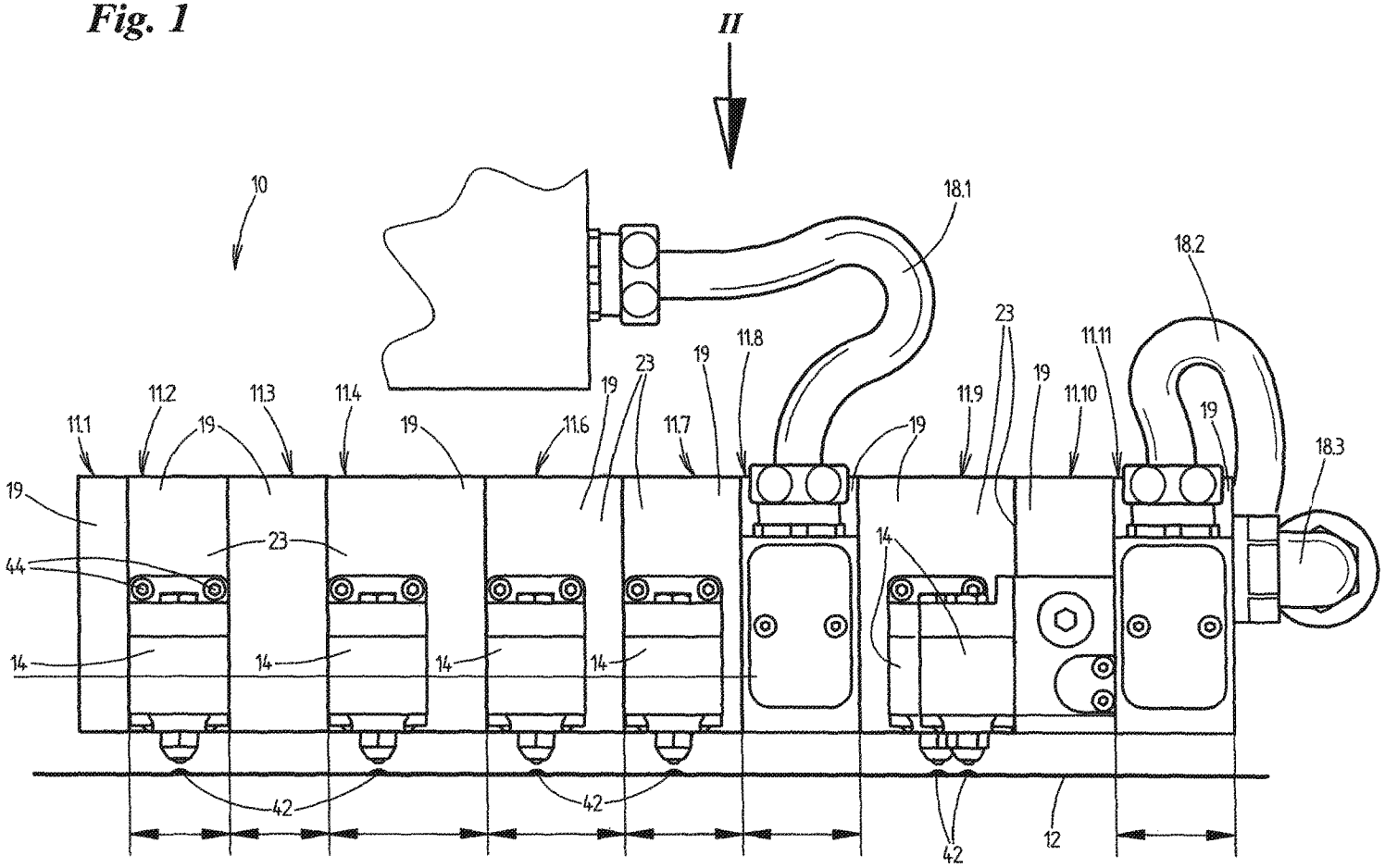
FIG. 1 shows a front view of a valve arrangement made up of a plurality of individual valves.
Figure 2:
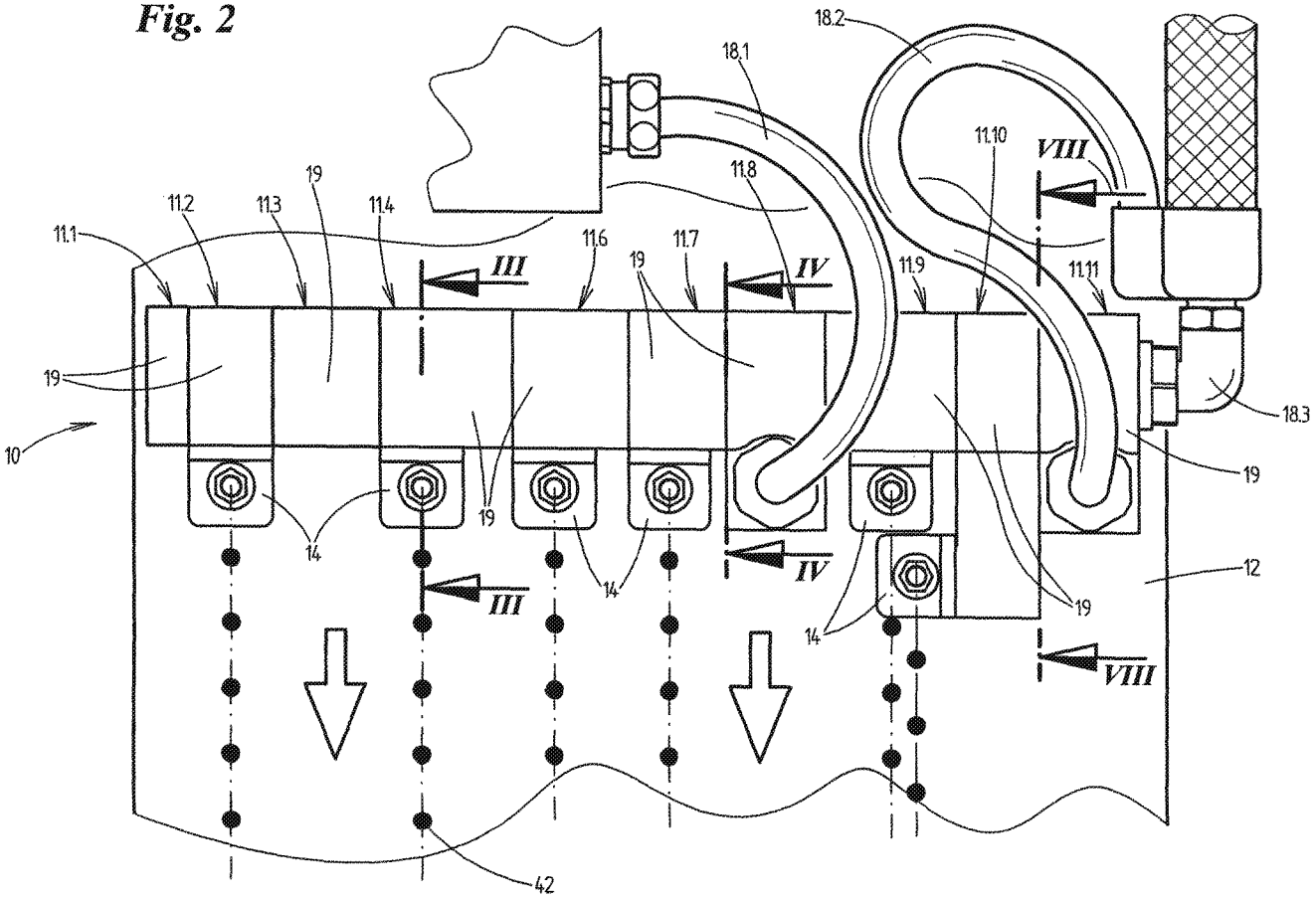
FIG. 2 shows a top view of the valve arrangement according to FIG. 1, according to the direction of view II in FIG. 1.

With the valve arrangement 10, single (small) portions of medium or glue 42 are respectively applied to the respective blank 12. For this purpose, the blank 12 is regularly moved relative to the valve arrangement 10, in particular transversely to the longitudinal extent of the same. In the present illustrative embodiment, the valve arrangement 10 is fixedly positioned, for example in a horizontal plane, and the blanks 12 to be provided with the medium or glue are conveyed, in a thereto parallel horizontal plane beneath the valve arrangement 10, along below the latter (arrow direction in FIG. 2). Correspondingly, respectively single, parallel medium or glue lines, which are distanced from one another perpendicularly to the direction of feed of the blank 12 or in the direction of the longitudinal extent of the valve arrangement 10, are formed from respectively single medium portions 42.

The individual modules 11.1-11.11 are arranged in the longitudinal extent of the valve arrangement 10 consecutively in a common row.

Pairs of two adjacent individual modules 11.1-11.11 are here respectively detachably connected to one another in a manner which is explained in greater detail later. Between each pair of individual modules 11.1-11.11 of the row of individual modules 11.1-11.11 is respectively formed a dividing plane 13. Hence, in the present illustrative embodiment, a total of ten dividing planes 13, in which corresponding bearing or flange surfaces 33 of the individual modules 11.1-11.11 of the respective individual module pair lie opposite one another and touch, are formed. Along the dividing planes 13, the valve arrangement 10 can be correspondingly split into the single individual modules 11.1-11.11, as part of a disassembly.

The individual modules 11.1-11.11 are in part differently constructed or have different functions.

Some individual modules, namely the individual modules 11.2, 11.4, 11.6, 11.7, 11.9, 11.10, respectively have a valve unit 14 with metering opening 15 integrated in the valve unit 14. All the metering openings 15 lie in a common (horizontal) plane.

Via these individual modules 11.2, 11.4, 11.6, 11.7, 11.9, 11.10 with valve unit 14, namely via the metering opening 15 of these same, the fluid medium is applied during the process to the surface of the blank 12. The precise structure of the valve units 14 is explained in greater detail later.

An individual module, namely the individual module 11.8, serves to connect the valve arrangement 10 to, in particular, power supply lines coming from the master (packaging) machine, in particular the machine control system, and, where appropriate, additional control lines 26. In the present case, the lines 26 are run inside a cable conduit 18.1. Starting from the module 11.8, the lines 26 are run through the valve arrangement 10 to the single modules 11.2, 11.4, 11.6, 11.7, 11.9, 11.10 with valve unit 14.

Another individual module, namely the individual module 11.11, serves, on the one hand, to connect the valve arrangement 10 to a medium source, for instance a hot-setting glue dispenser. For this purpose, a corresponding, in the present case heated, medium conduit 18.3 ends at the individual module 11.11. From the individual module 11.11, the medium guided via the conduit 18.3 is distributed inside the valve arrangement 10 and guided to the single modules 11.2, 11.4, 11.6, 11.7, 11.9, 11.10 with valve unit 14.

On the other hand, the individual module 11.11 serves to connect to power supply lines 27 preferredly likewise coming from the medium source or a control unit of the same. The lines 27 are run inside a cable conduit 18.2. Starting from the module 11.11, the lines 27 are run in the valve arrangement 10 to single heating members 17 of the valve arrangement 10. In the present case, the heating members 17 are constituted by heating cartridges.

Furthermore, the valve arrangement 10 has an individual module 11.3 (without valve unit 14) as an intermediate module. In the configuration of the valve arrangement 10, intermediate modules of this type primarily have the function, on the one hand, of influencing the total width of the valve arrangement 10 and, on the other hand, of being able to adjust the medium line spacing in the desired manner; in this case, the medium line spacing obtained between the individual modules 11.2 and 11.4 which respectively have a valve unit 14.

The total width of the valve arrangement 10, or the single medium line spacings predefined by the corresponding distances between the metering openings 15, can, of course, be influenced not only by the use of intermediate modules. In principle, the width of each of the single modules 11.1-11.11 can be individually chosen, so that, all in all, a chosen total width and chosen line spacings can ultimately be individually set.

It is pointed out that the position of various modules 11.1-11.11 in the common row can be varied. For example, the modules 11.8 and 11.11 for the connection of the abovementioned conduits or cables in the module row can be spatially positioned such that the corresponding cables and conduits can be optimally run to the master machine or the medium source.

Finally, the valve arrangement 10 also possesses an individual module 11.1, which as the last module in the common row serves as a terminating or end module. In the present case, the individual module 11.1 terminates the valve arrangement 10 on one side in the longitudinal direction.

Each of the individual modules 11.1-11.11 here possesses a main body 19. The single main bodies 19 respectively have on at least one (outer) side a or the aforementioned flange surface 33, which bears against the then respectively one corresponding flange surface 33 of the main body 19 of a or the adjacent individual module 11.1-11.11 in the common row.

The main bodies 19 of those individual modules 11.1-11.11 which in the common row are respectively adjoined by two other individual modules 11.1-11.11 correspondingly possess, on two opposite (outer) sides of the main body, in each case a corresponding flange surface 33.

With the exception of the main body 19 of the terminating module 11.1, all the other main bodies 19 of the individual modules 11.2-11.11, i.e. in particular also the intermediate module 11.3, respectively have a main medium duct 20 running, in the present case, preferredly parallel to the longitudinal extent of the valve arrangement 10. In any event, the main medium ducts 20 of those individual modules 11.1-11.11 in which, in the row of the individual modules 11.1-11.11, respectively two sides are adjoined by other individual modules 11.1-11.11, extend continuously from one (outer) side with flange surface 33 to the other (outer) side with flange surface 33.

The single main medium ducts 20 of the main bodies 19 of the single modules 11.2-11.11 here respectively connect, in particular in alignment, to one another, so that all in all a continuous duct 21, which extends from the main body 19 of the module 11.11 up to the main body 19 of the module 11.2, is obtained.

By contrast, the main body 19 of the terminating module 11.1 possesses no such main medium duct 20, but serves solely to terminally close off the main medium duct 20 of the (in the row) adjacent modules 11.2.

The main bodies 19 of the individual modules 11.2, 11.4, 11.6, 11.7, 11.9, 11.10 with respective valve unit 14 respectively possess, furthermore, a branch medium duct 22 leading off from the respective main duct 20.

The respective branch ducts 22 here end respectively at mounting (outer) sides 23 of the main bodies 19 of the individual modules 11.2, 11.4, 11.6, 11.7, 11.9, 11.10. For this purpose, they run, in any event at least in some sections, at an angle, in particular perpendicularly or transversely, to the respective main medium duct 20. The respective branch ducts 22 end respectively at a mounting surface 24 of the respective mounting side 23. To each mounting surface 24, the respective valve unit 14 is detachably fastened, in the present case by means of screws 44.

Apart from the main medium duct 20, the main bodies 19 of the individual modules 11.2-11.11 (i.e. with the exception of the terminating module 11.1) additionally respectively possess at least one cable duct 25, preferredly running respectively parallel to the respective main medium duct 20.

Through the latter are run, on the one hand, the power supply lines and, where appropriate, control lines 26 for the valve units 14, wherein the main bodies 19 of the individual modules 11.2, 11.4, 11.6, 11.7, 11.9, 11.10 with respective valve unit 14 here additionally respectively possess a branch cable duct 50, which leads off from the respective cable duct 25 and through which the lines 26 run through the cable duct 25 are guided onward up to the valve units 14.

On the other hand, the power supply lines 27 for the heating members 17 are run through the cable duct 25. For this purpose, the single cable ducts 25 of the respective modules 11.2-11.11 likewise connect to one another, so that correspondingly a continuous cable duct (where appropriate, running parallel to the continuous medium duct 21) is also obtained in the valve arrangement 10.

Preferredly, the cable ducts 25 of the single main bodies 19 are respectively aligned and also run parallel to the longitudinal extent of the valve arrangement 10. In any event, the cable ducts 25 of those individual modules 11.1-11.11 in which, in the row of individual modules 11.1-11.11, respectively two sides are adjoined by other individual modules 11.1-11.11, extend—like the main medium ducts 20—continuously from one (outer) side, with flange surface 33, of the corresponding main body 19 to the other (outer) side with flange surface 33.

Figure 5:
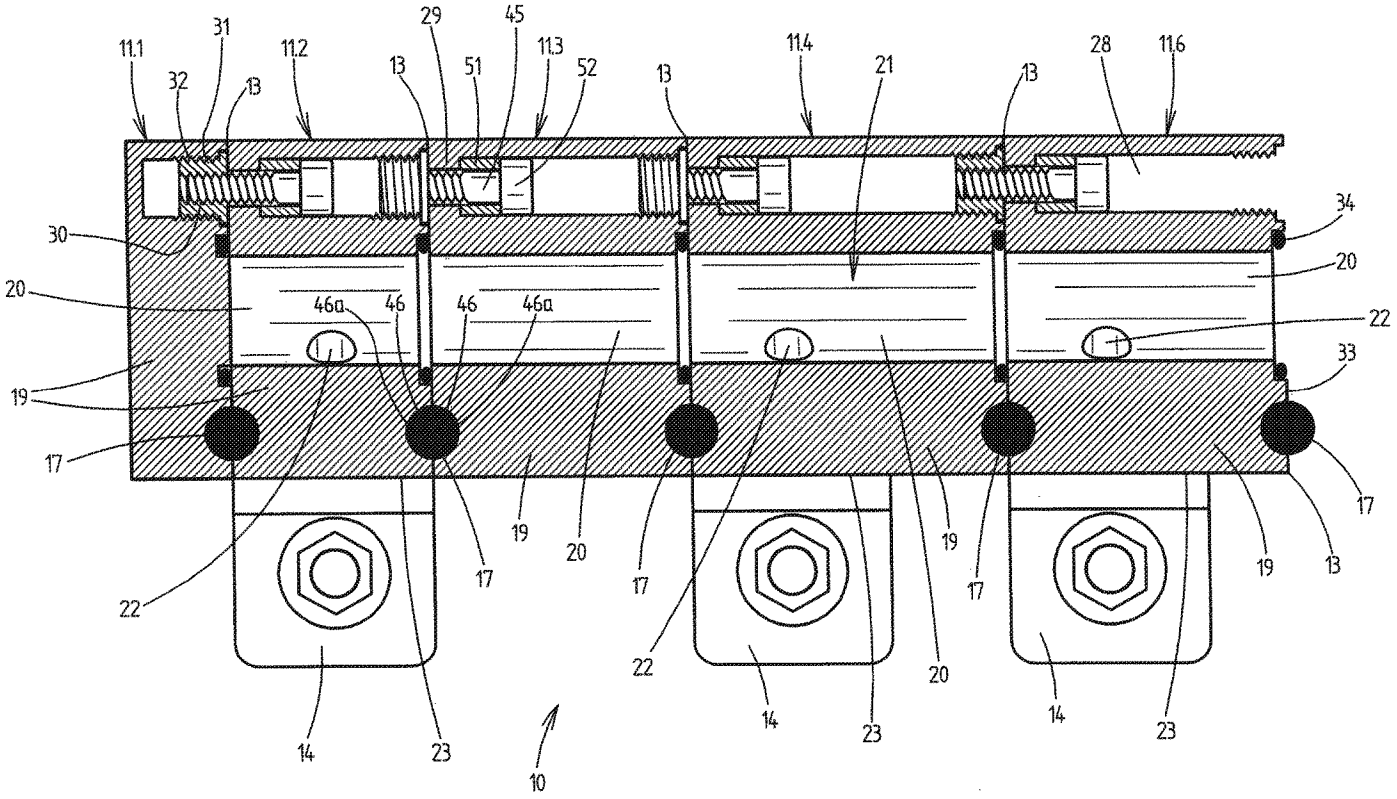
FIG. 5 shows a section through the valve arrangement, according to the sectional line V-V in FIG. 4.
Figure 6:
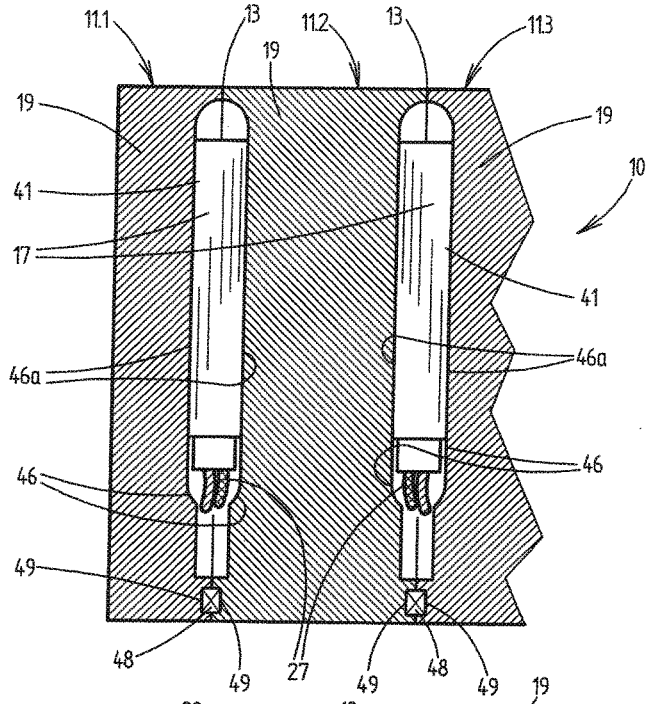
FIG. 6 shows a section through the valve arrangement, according to the sectional line VI-VI in FIG. 4.

In the present illustrative embodiment, respectively two main bodies 19 of the individual modules 11.1-11.11, which main bodies adjoin each other in the common row, are always connected to each other (cf. FIG. 5). For this purpose, corresponding connecting means are provided. In the present case, these are connecting screws 45. These reach through bores 28, which in any event, in the case of the non-terminal modules 11.2-11.10, extend from one (outer) side, with flange surface 33, of a main body 19, to the other (outer) side, with flange surface 33, of this main body 19. Theoretically it is conceivable also to connect more than respectively two individual modules 11.1-11.11 one to another.

The bores 28 respectively have a reduction 29 disposed within the respective main body 19, or a cross-sectional restriction. An, in the present case, hollow-cylindrical spacer 51 is respectively supported against an, in the present case, annular stop face running at an angle, in particular perpendicularly, to the longitudinal center axis of the respective bore 28 or of the respective reduction 29, or an end of said spacer bears against this stop face. The respectively other end of the respective spacer 51 serves as a bearing surface or stop face for the respective screw head 52 of the respective screws 45. The respective length of the screws 45 configured as standard screws is chosen, preferredly in each case identically, such that they can be screwed into an internal thread 30 of a respectively other, in particular adjacent, main body 19. More specifically, they can be screwed, for example, into an internal thread 30 of a threaded piece 31 screwed into a further internal thread 32 of the other main body 19. The bores 28 are preferredly distributed coaxially about the respective main medium duct 20 of the respective main body 19. They are disposed, in particular, respectively at identical distance to the main medium duct 20, so that they are distributed, in cross section, along the same circular line. Also the angular distances between respectively two adjacent screws 45 on the circular line are identical.

The main bodies 19 are preferredly produced from aluminum. By contrast, the material from which the spacers 51 are produced is preferredly steel. The background is that steel has a significantly smaller coefficient of thermal expansion than aluminum. Correspondingly, thermally induced stresses which act on the screws 45 and which can be generated during operation by the warming of the individual modules 11.1-11.11, and in particular by the corresponding heating of the spacer 51, are kept as small as possible.

Figure 7:
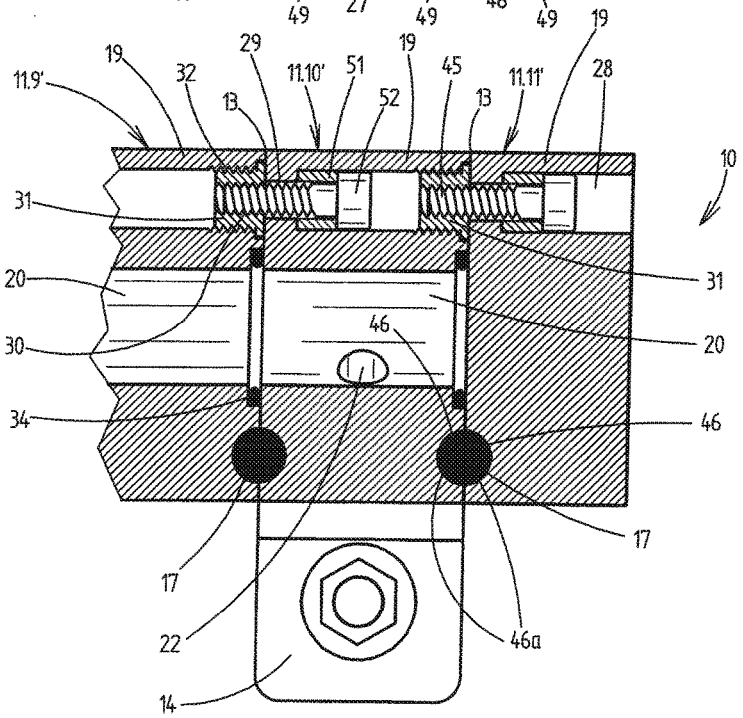
FIG. 7 shows a representation of the left segment of the valve arrangement according to FIG. 5, though with modified end module.

The bores 28 of the end module 11.1 are correspondingly arranged in alignment with the bores 28 of the adjacent module 11.2, but in the embodiment of FIG. 5 do not reach through the end module 11.1. This is different in an alternative embodiment according to FIG. 7, which shows modules 11.9', 11.10' and 11.11'. The bore 28 of the terminal terminating module 11.11' reaches through the end module 11.11', starting from the outer side of this same. Correspondingly, the screw 45 can be screwed in from this side.

As a result of the above-stated measures, in the assembly of the single main bodies 19 a constant surface pressure of the main bodies 19 or individual modules 11.1-11.11 respectively connected to one another in this way is respectively achieved.

Unlike in the present embodiment, it can be provided to shape the modules 11.1-11.11 as far as possible symmetrically, so that the screws 45 can in principle be inserted also from both (outer) sides of the respective main body 19.

For sealing purposes, a ring seal 34 is respectively disposed between respectively two main medium ducts 20 of the main bodies 19 of adjacent individual modules 11.2-11.11. A further ring seal 34 is disposed between the main medium duct 20 of the main body 19 of the individual module 11.2 and a wall of the end module 11.1, which wall laterally bounds this main medium duct 20.

As far as the valve units 14 are concerned, these are constituted in the present case by solenoid valves. Other valves can also be used. The valve units 14 have an, in the present case, two-part housing 35, having an upper housing part 35*a* and a lower housing part 35*b*. The valve unit 14 is—as already mentioned—detachably connected to the respective main body 19, in the present case by the screws 44. Within the valve housing 35, namely in a valve housing interior or a valve housing chamber, are in the present case arranged two coils 36 of two electromagnets. Each electromagnet here respectively possesses a coil 36. In principle, only one electromagnet having one or more coils, or more than two electromagnets having respectively one or more coils, could also be used.

In the present embodiment of the valve unit 14, the two coils 36 are both wound on a common coil carrier or coil former 37. They are not represented separately or individually.

Within a hollow-cylindrical portion of the coil carrier 37 is movably arranged a closure or metering member 38, namely a valve lifter.

Figure 3:
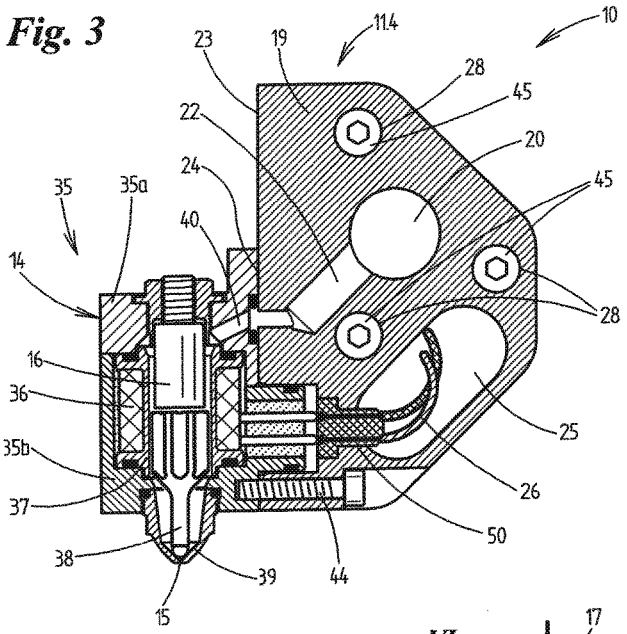
FIG. 3 shows a section through the valve arrangement, according to the sectional line III-Ill in FIG. 2.
Figure 4:
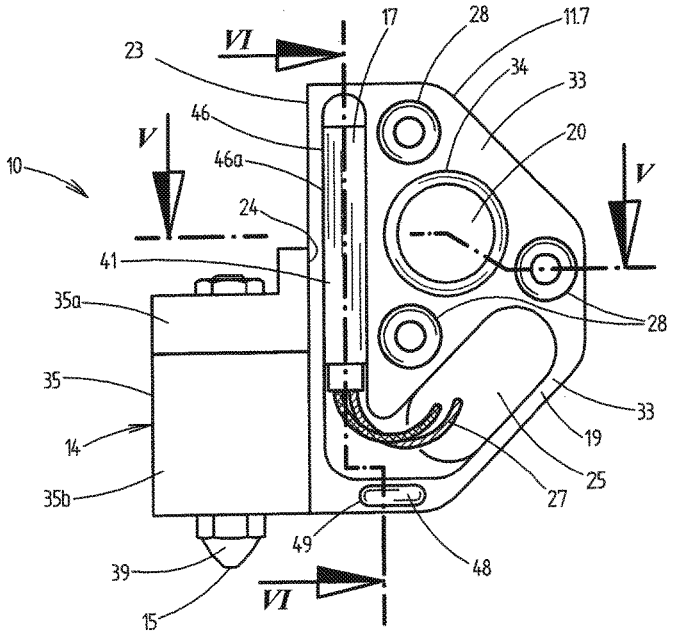
FIG. 4 shows a section through the valve arrangement, according to the sectional line IV-IV in FIG. 2.

In the present case, a ball, as closure means for the metering or valve opening 15, is fastened to a lower shaft of the metering member 38. The metering opening 15 is disposed centrally in the region of a funnel-shaped valve seat or in the region of a corresponding valve nozzle 39. In that closed position of the valve unit 14 which is shown in FIG. 3, the ball bears against conical seating surfaces of the valve nozzle 39 and closes off the metering opening 15.

The medium to be metered, in particular glue or hot-setting glue, is firstly fed to the individual module 11.11 via the heated conduit 18.3 from the medium or glue source (not represented) and is subsequently led via the respective main medium ducts 20 or the respective medium branch ducts 22 within the valve arrangement 10 to the respective valve unit 14. More specifically, the medium here flows into a duct 40 within the valve housing 35, from there into the interior, surrounded by the coil carrier 37, of the valve unit 14, and subsequently in the direction of the nozzle 39 or metering opening 15.

Through a suitable feed of electrical current to the coils 36 or the electromagnets, the respective closure member 38 of the respective valve unit 14 is opened upward during operation. Restoring forces then ensure a closing movement of the closure member 38 as soon as the opening forces applied by the electromagnet cease. The restoring forces are produced by two mutually repelling individual magnets, of which one is disposed on the closure member 38, the other on a counterpart 16 serving also as a stop.

Of particular importance is the arrangement of the aforementioned heating members 17. In the present case, each of the dividing planes 13 is assigned a dedicated heating member 17. The heating members 17 are in the present case configured as so-called heating cartridges. More specifically, they have a substantially cylindrical peripheral surface 41. However, the peripheral surface can also, of course, have a different shape.

The heating members 17 are respectively seated in two appropriate, mutually opposing and complementary elongate receptacles 46 of main bodies 19 of the individual modules 11.1-11.11, which main bodies are adjacent in the row or mutually adjoining, or a pair of adjacent main bodies 19. A receptacle 46 is correspondingly assigned to the (outer) side of the respectively one main body 19, the other receptacle 46 to the opposite (outer) side of the respectively other, adjacent or adjoining main body 19. More specifically, each receptacle 46 is made, in particular milled, in the respective flange surfaces 33.

The respective two mutually opposing receptacles 46 here fully, or substantially fully, enclose the respective heating member 17 or its peripheral surface 41 in the radial direction.

In the present case, the elongate receptacles 46 extend perpendicularly to the longitudinal extent of the valve arrangement, to be precise vertically or from bottom to top. They respectively have a lateral wall 46*a* with corresponding inner surface. The dimensions of the respectively opposing receptacles 46 are here adapted to the heating member 17 such that the peripheral surface 41 of the heating member 17 bears against the two, in the present case semi-cylindrical walls 46*a* with correspondingly semi-cylindrical inner surfaces of the opposing receptacles 46, in particular full-facedly, to be precise over the whole of the peripheral surface 41.

As a result, a particularly good heat transfer between the respective heating member 17 and the respective main body 19 is achieved, which all in all helps to ensure an even heat distribution in the valve arrangement 10. In principle, it is here also conceivable that the respective heating member 17 is seated in the receptacles 46 with some (lateral) clearance, which is then filled with a heat-conducting paste.

Figure 8:
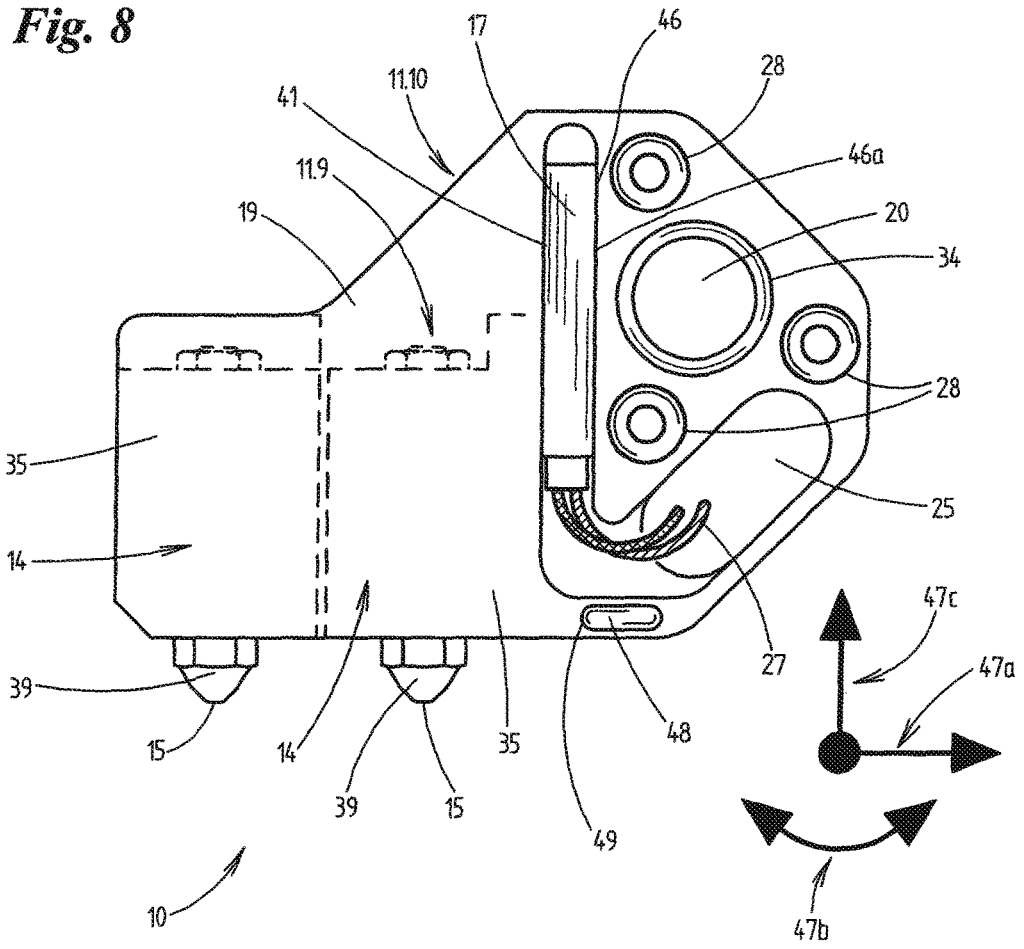
FIG. 8 shows a section through the valve arrangement, according to the sectional line VIII-VIII in FIG. 2.

The particular arrangement of the heating members 17 also means that relative movements of the adjacent main bodies 19 with motional components in the direction transversely to the longitudinal extent of the heating member 17 are not possible, cf. the motional arrows 47*a* and 47*b* in FIG. 8. In the present case, these are relative movements with motional components which are directed at once transversely to the longitudinal extent of the heating member 17 and transversely to the longitudinal extent of the valve arrangement 10.

In order also to limit or prevent relative movements of adjacent main bodies 19 with motional components which are directed at once parallel to the longitudinal extent of the heating member 17 and transversely to the longitudinal extent of the valve arrangement 10, cf. motional arrow 47*c* in FIG. 8, a corresponding adjusting spring 48 is respectively additionally assigned to the dividing planes 13. This adjusting spring 48 is respectively seated in appropriate, mutually opposing recesses 49 of the mutually opposing (outer) sides of the adjacent main bodies 19. In particular, these recesses 49 are made, or likewise milled, in the corresponding flange surfaces 33.

The aforesaid position fixings are helpful, in particular, in the assembly of the individual modules 11.1-11.11, before the described connection is established via the screws 45.

A further particularity is constituted by the individual module 11.10. Like the other individual modules 11.2, 11.4, 11.6, 11.7, 11.9, it too has a valve unit 14. However, this valve unit 14 is arranged forwardly offset in relation to the other valve units 14 of the other modules 11.2, 11.4, 11.6, 11.7, 11.9 in the (horizontal) direction transversely to the longitudinal extent of the valve arrangement 10.

This is achieved by the projection of the main body 19 of the module 11.10, in the aforesaid transverse direction, over a common plane of the valve unit mounting sides 23 of the main bodies 19 of the other modules 11.2, 11.4, 11.6, 11.7, 11.9.

Moreover, the mounting side 23 or the mounting surface 24 of the module 11.10 is arranged at an angle, or in the present case perpendicularly, to the mounting sides 23 or mounting surfaces 24 of the other modules 11.2, 11.4, 11.6, 11.7, 11.9, namely such that it is facing toward the adjacent module 11.9.

The valve unit 14 is here disposed on the module 11.10 at such a distance to the mounting sides 23 of the other modules 11.2, 11.4, 11.6, 11.7, 11.9 that the valve unit 14 of the module 11.10 can be arranged offset in the longitudinal direction of the valve arrangement 10 or in the direction of the adjacent module 11.9.

In relation to the direction transversely to the longitudinal extent of the valve arrangement 10, the valve units 14 (or the housings 35 of these same) of the two adjacent modules 11.9 and 11.10 are arranged (with lateral offset) one behind the other.

In relation to the longitudinal extent of the valve arrangement 10, by contrast, the two valve units 14 (or the housings 35) overlap. As a result of this overlap, the distance between the medium lines of the module 11.9 and of the module 11.10 are reduced to a value which is smaller than the width of the main bodies 19 of the modules 11.9 or 11.10.

As can be seen, the nozzle openings 15 of the modules 11.2, 11.4, 11.6, 11.7, 11.9 correspondingly lie on an (imaginary) straight, common line parallel to the longitudinal extent of the valve arrangement 10, while the nozzle opening 15 of the module 11.10 is arranged at a distance to this line in front of it in said transverse direction.

A further important aspect relates to the ratio of the width of the respective main body 19 of the respective individual module 11.4, 11.6, 11.7, 11.9, 11.10 with valve unit 14 to the width of the valve unit 14 respectively disposed on the respective individual module 11.4, 11.6, 11.7, 11.9, 11.10, in particular to the width of the housing 35 of the valve unit 14. This ratio should preferredly assume no more than the value 2, thus values <=2, particularly preferredly no more than the value 1.6 or <=1.6. It has been shown that, at the aforesaid maximum width ratio, a good heat transfer from the heating members 19 arranged in the dividing planes 13 to the valve units 14 is ensured. Expediently, the ratio will assume at least the value 1, moreover, so that the ratio assumes a value between 1 and 2 or 1 and 1.6.

REFERENCE SYMBOL LIST

10 valve arrangement
11.1 individual module
11.2 individual module
11.3 individual module
11.4 individual module
11.6 individual module
11.7 individual module
11.8 individual module
11.9 individual module
11.10 individual module
11.11 individual module
11.9' individual module
11.10' individual module
11.11' individual module
12 blank
13 dividing plane
14 valve unit
15 metering opening
16 counterpart
17 heating cartridge
18.1 conduit
18.2 conduit
18.3 conduit
19 main body
20 main medium duct
21 duct
22 branch medium duct
23 mounting side
24 mounting surface
25 cable duct
26 power supply line
27 power supply line
28 bore
29 reduction
30 internal thread
31 threaded piece
32 internal thread
33 flange surface
34 ring seal
35 housing
**35*a*** housing part
**35*b*** housing part
36 coil
37 coil former
38 metering member
39 valve nozzle
40 medium duct
41 peripheral surface
42 glue portions
44 screws
45 screws
46 receptacle
**46*a*** lateral wall
**47*a*** motional arrow
**47*b*** motional arrow
**47*c*** motional arrow
48 adjusting spring
49 recesses
50 branch cable duct
51 spacer
52 screw head

The invention claimed is:

1. A valve arrangement for applying fluid media to surfaces, comprising a plurality of individual modules (11.1-11.11) detachably connected to form a row, wherein at least one dividing plane (13) is formed between adjacent modules of the plurality of individual modules (11.1-11.11), and the adjacent modules of the plurality of individual modules (11.1-11.11) bear one against another; wherein the at least one dividing plane (13) is assigned a heating member (17) for warming the valve arrangement (10), the heating member being seated in mutually opposing receptacles (46), arranged to both sides of the at least one dividing plane (13), of the adjacent modules of the plurality of individual modules (11.1-11.11), and cooperates in such a way with walls (**46*a*) of the plurality of individual modules (11.1-11.11) which delimit the receptacles (46) and that limit or prevent relative movement of the adjacent modules of the plurality of individual modules (11.1-11.11) in at least one spatial direction; wherein at least one of the plurality of individual modules (11.1-11.11) respectively possesses a main body (19) having a main medium duct (20) that extends in a longitudinal direction of the valve arrangement (10) and connects to the corresponding main medium duct (20) of the main body (19) of an adjacent module of the plurality of individual modules (11.1-11.11); and wherein the at least one of the plurality of individual modules (11.1-11.11) respectively possesses a cable duct (25), extending in the longitudinal direction of the valve arrangement (10), for power cables and for control cables, wherein the cable duct connects to a corresponding cable duct of the main body (19) of an adjoining module of the plurality of individual modules (11.1-11.11**).

2. The valve arrangement as claimed in claim 1, wherein the heating member (17) has a cylindrical peripheral surface (41), which lies opposite and bears against cylindrical inner surfaces formed by the mutually opposing receptacles (46) of the plurality of individual modules (11.1-11.11).

3. The valve arrangement as claimed in claim 1, wherein a respective one of the plurality of individual modules (11.1-11.11) possesses a solenoid valve unit (14), detachably fastened to a mounting surface (24) of the main body (19), the solenoid valve unit (14) having a metering opening (15) for the discharge of the medium.

4. The valve arrangement as claimed in claim 3, wherein the heating member (17) is of elongate configuration and extends perpendicularly to a longitudinal extent of the valve arrangement (10).

5. The valve arrangement as claimed in claim 3, wherein the main body (19) of the respective one of the plurality of individual modules (11.1-11.11) with the valve unit (14) has a branch medium duct (22), which runs perpendicularly to the main medium duct (20), connects to the main medium duct (20), and leads to the valve unit (14).

6. The valve arrangement as claimed in claim 3, wherein the ratio of a width of the main body (19) of the respective individual module (11.1-11.11) with the valve unit (14) to the width of a housing of the valve unit (14) disposed on the respective individual module (11.1-11.11) amounts to no more than the value 2.

7. The valve arrangement as claimed in claim 3, wherein the main body (19) of the respective individual module (11.1-11.11) with the valve unit (14) has a branch cable duct (50), which runs perpendicularly to the cable duct (25), connects to the cable duct (25), and leads to the valve unit (14).

8. The valve arrangement as claimed in claim 3, wherein the ratio of a width of the main body (19) of the respective one of the individual modules (11.1-11.11) with the valve unit (14) to the width of a housing of the valve unit (14) disposed on the respective one of the individual modules (11.1-11.11) amounts to no more than the value 1.6.

9. The valve arrangement as claimed in claim 1, wherein respectively at least two of the plurality of individual modules (11.1-11.11) are screwed together by at least three connecting screws (45), which run at an equal distance to the main medium duct (20) of the main body (19) of one of the at least two of the plurality of individual modules (11.1-11.11), and parallel to the one of the at least two of the plurality of individual modules (11.1-11.11), and at a respectively equal angular distance to one another, and extend through corresponding bores (28) in the main body (19) of the one of the at least two of the plurality of individual modules (11.1-11.11), which the connecting screws are screwed respectively into an associated internal thread (32) of a threaded piece (31) respectively screwed into the main body (19) of another of the at least two of the plurality of individual modules (11.1-11.11).

10. The valve arrangement as claimed in claim 9, wherein a screw head (52) of a respective one of the at least three connecting screws (45) within the bore (28) of the one of the at least two of the plurality of individual modules (11.1-11.11) bears against a bearing surface of a separate hollow-cylindrical spacer (51) disposed within the bore (28), the hollow-cylindrical spacer is in turn supported against an annular bearing surface within the bore (28), the bearing surface runs perpendicularly to a longitudinal center axis of the bore (28), wherein a material from which the hollow-cylindrical spacer (51) is produced has a smaller coefficient of thermal expansion than a material from which the main bodies (19) of the at least two of the plurality of individual modules (11.1-11.11) are produced.

11. The valve arrangement as claimed in claim 10, wherein the material from which the hollow cylindrical spacer (51) is produced is steel and the material from which the main bodies (19) of the at least two of the plurality of individual modules (11.1-11.11) are produced is aluminum.

12. A valve arrangement for applying fluid media to surfaces, comprising a plurality of individual modules (11.1-11.11) detachably connected in a longitudinal direction of the valve arrangement (10) to form a row, wherein at least one dividing plane (13) is formed between adjacent modules of the plurality of individual modules (11.1-11.11), and the adjacent modules of the plurality of individual modules (11.1-11.11) bear one against another; wherein the plurality of individual modules (11.1-11.11) respectively possess a metering opening (15), disposed on the same side of the valve arrangement (10), for the discharge of the medium; wherein the metering openings (15) of at least two of the plurality of individual modules (11.1-11.11) are disposed on an imaginary common straight line running in parallel to the longitudinal direction of the valve arrangement (10); wherein the metering opening (15) at least of another of the plurality of individual modules (11.1-11.11) is arranged at a distance to the imaginary common straight line; and wherein the plurality of individual modules (11.1-11.11) with the metering opening (15) respectively have a valve unit (14) with a housing (35), the metering opening (15) being integrated in the valve unit, and a main body (19) with a mounting surface (24) to which the housing (35) of the valve unit (14) is fastened, and in that a mounting surface (24) of the main body (19) of each of the plurality of individual modules (11.1-11.11) whose metering opening (15) is not disposed on the imaginary common straight line is arranged at a right angle and at a distance to the mounting surfaces (24) of the main bodies (19) of the at least two of the plurality of individual modules (11.1-11.11), whose metering openings (15) are disposed on the imaginary common straight line.

13. The valve arrangement as claimed in claim 12, wherein the mounting surfaces (24) of the main bodies (19) of the at least two of the plurality of individual (11.1-11.11) whose metering openings (15) are disposed on the imaginary common straight line lie in a common plane or are mutually aligned, and in that the mounting surface (24) of the main body (19) of the plurality of individual modules (11.1-11.11) whose metering opening (15) is disposed at a distance to the imaginary common straight line is arranged perpendicularly and at a distance to the common plane.

14. The valve arrangement as claimed in claim 12, wherein the housing (35) of the valve unit (14) of the plurality of individual modules (11.1-11.11) whose metering opening (15) is not disposed on the imaginary common straight line is arranged laterally offset in relation to a direction perpendicular to the longitudinal direction of the valve arrangement (10), behind the housing (35) of the valve unit (14) of one of an adjacent ones of the at least two plurality of individual modules (11.1-11.11), with the metering opening (15) lying on the imaginary common straight line, such that the housings (35) of two of the plurality of individual modules (11.1-11.11) overlap in the longitudinal direction of the valve arrangement (10).

* * * * *